US009089251B2

(12) United States Patent
Hodge et al.

(10) Patent No.: US 9,089,251 B2
(45) Date of Patent: Jul. 28, 2015

(54) METHOD OF REMOVING AND PREVENTING REDEPOSITION OF PROTEIN SOILS USING SUGAR ESTERS

(75) Inventors: Charles A. Hodge, Cottage Grove, MN (US); Erin J. Dahlquist, West St. Paul, MN (US); Amanda R. Blattner, Prior Lake, MN (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

(21) Appl. No.: 13/273,339

(22) Filed: Oct. 14, 2011

(65) Prior Publication Data

US 2013/0092197 A1 Apr. 18, 2013

(51) Int. Cl.

| | |
|---|---|
| ***B08B 3/00*** | (2006.01) |
| ***A47L 15/00*** | (2006.01) |
| ***C11D 1/66*** | (2006.01) |
| ***C11D 11/00*** | (2006.01) |
| *A47L 15/42* | (2006.01) |

(52) U.S. Cl.

CPC ..... *A47L 15/0007* (2013.01); *A47L 15/00* (2013.01); *C11D 1/662* (2013.01); *C11D 1/667* (2013.01); *C11D 11/0064* (2013.01); *A47L 15/0047* (2013.01); *A47L 15/4214* (2013.01); *A47L 15/4219* (2013.01); *A47L 15/4291* (2013.01); *A47L 15/4297* (2013.01); *A47L 2501/03* (2013.01); *A47L 2501/06* (2013.01); *A47L 2501/07* (2013.01)

(58) Field of Classification Search

CPC C11D 1/667; A47L 15/0047; A47L 15/4214; A47L 15/4219; A47L 15/4291; A47L 15/4297; B08B 3/00; B08B 3/02; B08B 3/04; B08B 3/024; B08B 3/08

USPC ..... 134/25.2, 26, 29; 510/514

See application file for complete search history.

(56) References Cited

U.S. PATENT DOCUMENTS

| | | | | |
|---|---|---|---|---|
| H468 | H | 5/1988 | Malik et al. | |
| 4,872,466 | A * | 10/1989 | Noren | 134/57 D |
| 5,320,118 | A * | 6/1994 | Fernholz | 134/93 |
| 5,527,483 | A | 6/1996 | Kenkare et al. | |
| 6,017,864 | A | 1/2000 | Brittain et al. | |
| 6,484,734 | B1 | 11/2002 | Everson et al. | |
| 6,694,989 | B2 | 2/2004 | Everson et al. | |
| 6,812,202 | B2 | 11/2004 | Man et al. | |
| 8,038,802 | B1 * | 10/2011 | Tuller | 134/25.2 |
| 8,157,923 | B1 * | 4/2012 | Mohrbacher et al. | 134/25.2 |
| 8,216,989 | B2 | 7/2012 | Silvernail et al. | |
| 2010/0300487 | A1 * | 12/2010 | Rolek et al. | 134/10 |
| 2012/0145195 | A1 * | 6/2012 | Buser et al. | 134/18 |

FOREIGN PATENT DOCUMENTS

| | | |
|---|---|---|
| EP | 1027420 | 5/2004 |
| EP | 1077250 | 1/2005 |
| WO | WO98/50510 | 11/1998 |
| WO | WO 2009117256 A2 * | 9/2009 |

* cited by examiner

*Primary Examiner* — Bibi Carrillo
(74) *Attorney, Agent, or Firm* — Eric DeMaster

(57) ABSTRACT

A novel approach to the method of removing and preventing redeposition of protein soils on surfaces using sugar esters is disclosed. Protein deposition and streaking and spotting are common on machine washed dishes. Applicants have found a new method of recycling a sump water composition in an automatic dish machine from a first cleaning cycle into subsequent cleaning cycles using a protein-removing/anti-redeposition agent that can remove and prevent redeposition of protein soils on ware washed surfaces.

14 Claims, 1 Drawing Sheet

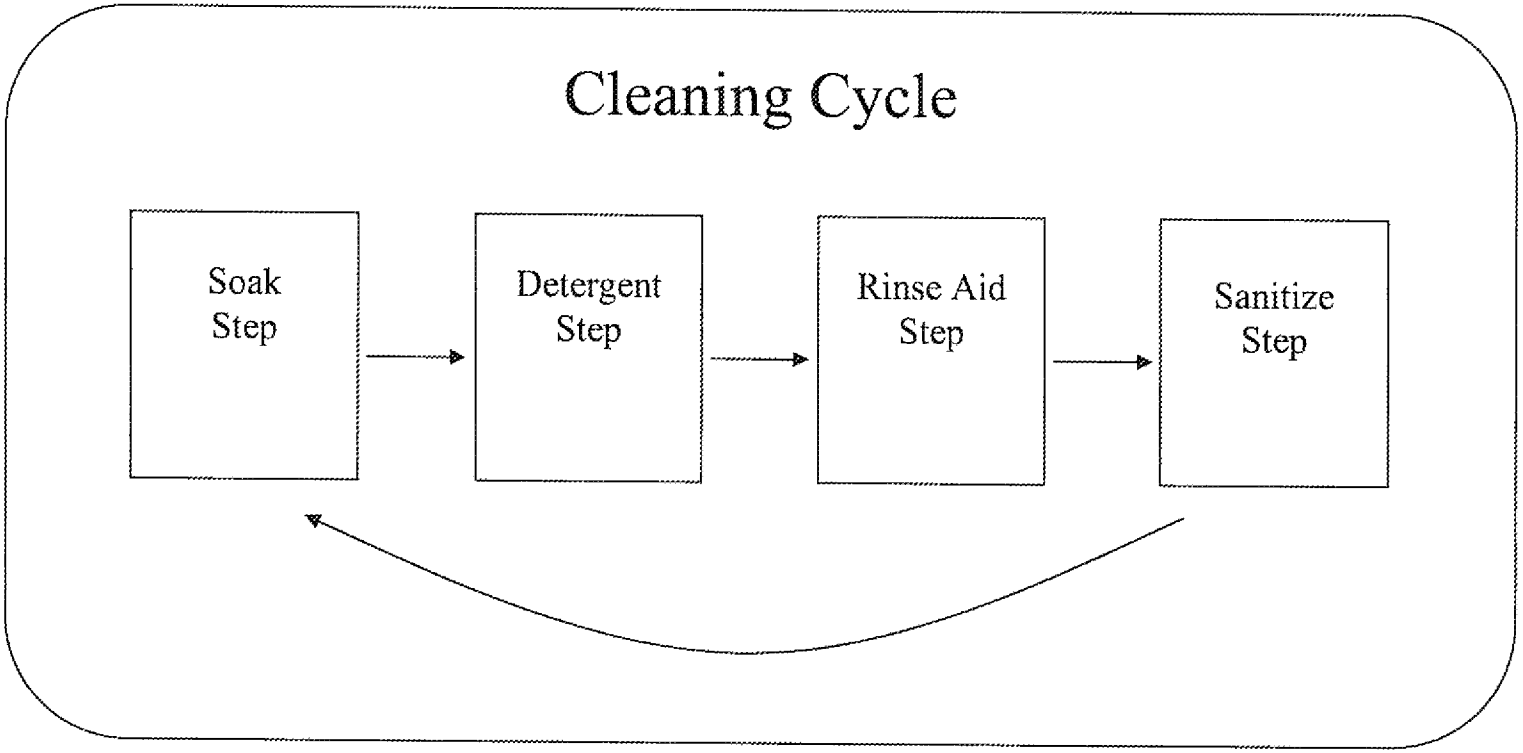
Cleaning Cycle
Soak Step
Detergent Step
Rinse Aid Step
Sanitize Step

METHOD OF REMOVING AND PREVENTING REDEPOSITION OF PROTEIN SOILS USING SUGAR ESTERS

FIELD OF THE INVENTION

The present invention relates generally to the field of cleaning compositions. In particular, the present invention is a method of removing and preventing redeposition of protein soils on surfaces using sugar esters.

BACKGROUND OF THE INVENTION

Both institutional and consumer automatic dishwashers or warewashing machines have been in use for many years. These dishwashers typically function with one or more steps during a cleaning cycle. The cycle includes various combinations of a soak or a presoak process, a main detergent wash process, a rinse process, and a high temperature or chemical sanitizing rinse process. A dishwasher detergent composition is typically utilized during the main detergent wash process to remove soils and stains. Often, the detergent composition will include water softeners or sequesterants, bleaching and sanitizing agents, and an alkali source. Glasses and other wares washed in automatic washing machines are preferably obtained without food soils and without residue from the cleaning solutions or other chemicals used in the detergent wash process.

One type of residue, known as protein deposition, is common on machine washed dishes. Glasses and other ware washed in automatic dishwashing machines commonly include left on food soils. Often the detergent composition alone is not able to fully remove all protein depositions and food soils remain on the surface of the wares even after they have been through the detergent wash process.

A second type of residue, known as streaking and spotting, is also common on machine washed dishes. Streaking and spotting is believed to result when water salts deposit on the dishes after the rinse drainage and evaporation. Glasses and other ware washed in automatic dishwashing machines commonly include residue from the cleaning solutions or other chemicals used in the detergent wash process. Rinse additives or aids are commonly added to rinse water in an effort to reduce surface tension of the rinse water and thereby promote sheeting of the water from the dishes. Typical rinse aid formulas require solution concentrations ranging from about 10 ppm to 100 ppm (depending on actives) to provide efficient sheeting and drying.

In general, rinse aids minimize spotting and promote faster drying by causing the rinse water to sheet off of the clean dishes and other wares evenly and quickly. Rinse aids are generally used after the detergent composition.

A substantial need exists for a method of removing protein residue and preventing redeposition of protein soils at relatively low solution concentrations without leaving any residue from the cleaning solutions or other chemicals used in the detergent wash process.

SUMMARY OF THE INVENTION

In one embodiment, the present invention is a method of removing protein soils from a surface and preventing the redeposition of protein soils onto the surface. The method includes introducing a wash water composition which includes a detergent composition with an alkalinity source during a first detergent step and introducing a rinse aid composition during the first rinse step. The surface of the ware is washed with the detergent composition during a heated suds step of the first detergent step and rinsed during the first rinse step forming a sump water composition after the first cleaning cycle. Part of the sump water composition is recycled into a second cleaning cycle, and fresh water is introduced during the second rinse step, wherein the sump water composition in the second cleaning cycle includes a combination of fresh water and sump water composition that includes detergent and rinse aid. This entire method is repeated in subsequent cleaning cycles. The rinse aid composition includes a protein-removing/anti-redeposition agent which further includes a sugar ester. The sugar ester may be a sucrose aliphatic ester, a sorbitan aliphatic ester, or a mixture thereof. Preferably, the rinse aid composition comprises of between about 40 to about 90 weight percent, preferably about 80 weight percent, sucrose aliphatic ester and about 2 to about 30 weight percent, preferably about 20 weight percent, sorbitan aliphatic ester. During the detergent step of the cleaning cycle, which includes a temperature range of about 100 degrees Fahrenheit to about 200 degrees Fahrenheit, the heat and alkalinity from the water breaks the sugar ester into sucrose which helps remove protein deposition on the surface of the wares. With each subsequent cleaning cycle, the concentration of sucrose in the wash water composition is gradually increased by the recycled sump water composition which aids in preventing the redeposition of protein soils on the surface of the wares.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 1 is a flow diagram illustrating the cleaning cycle of the present invention.

DETAILED DESCRIPTION OF THE INVENTION

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt. %, and most preferably, the amount of phosphate is less than 0.01 wt %.

As used herein, the term "phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt. %, and most preferably the amount of phosphorus is less than 0.01 wt %.

"Cleaning" means to perform or aid in soil removal, bleaching, microbial population reduction, rinsing, or combination thereof.

As used herein, the term "ware" includes items such as eating and cooking utensils. As used herein, the term "warewashing" refers to washing, cleaning, or rinsing ware.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g. 1 to 5 includes 1, 1.5, 2, 2.75, 3, 3.80, 4, and 5).

The present invention relates to detergent compositions/rinse aid compositions and methods of using the detergent compositions/rinse aid compositions to remove protein soils from surfaces and to prevent redeposition of the soils on surfaces. The rinse aid composition includes an agent for removing protein soil and preventing redeposition including a sugar ester. In one embodiment, the detergent compositions/rinse aid compositions are substantially free of phosphates. Unlike most cleaning compositions currently known in the art, cleaning compositions do not have to include phosphates to be effective. Thus, the detergent compositions/rinse aid compositions of the present invention provide a green replacement for conventional cleaning compositions. In addition, in one embodiment, the detergent compositions/rinse aid compositions are substantially free of alkali earth metals. The detergent compositions/rinse aid compositions can be used in various industries, including, but not limited to: warewash (institutional and consumer), food and beverage, and health care. In particular, the detergent compositions/rinse aid compositions can be safely used on glass, ceramic, plastic and metal surfaces.

Detergent Composition

The detergent composition includes an alkalinity source, such as an alkali metal carbonate or alkali metal silicate. Examples of suitable alkalinity sources include, but are not limited to: sodium hydroxide, potassium hydroxide, sodium carbonate, potassium carbonate or a mixture of alkali metal hydroxide and alkali metal carbonate. Examples of particularly suitable alkalinity sources include, but are not limited to: sodium carbonate, sodium hydroxide, or a mixture of sodium carbonate and sodium hydroxide. The alkalinity source controls the pH of the resulting solution when water is added to the detergent composition to form a use solution. The pH of the detergent composition must be maintained in the alkaline range in order to provide sufficient detergency properties. In an exemplary embodiment, at between about a 0.5% and about a 2.5% solution, the pH of the detergent composition is between about 10 and about 12, preferably between about 10.5 to about 11. If the pH of the detergent composition is too low, for example, below approximately 10, the detergent composition may not provide adequate detergency properties. If the pH of the detergent composition is too high, for example, above approximately 12-12.5, the detergent composition may become too alkaline and begin to attack the surface to be cleaned.

The detergent composition also includes a surfactant component that functions primarily as a defoamer and as a low foam surfactant. Optionally, a variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of optional anionic surfactants useful in the detergent composition include, but are not limited to: carboxylates such as alkylcarboxylates (carboxylic acid salts) and polyalkoxycarboxylates, alcohol ethoxylate carboxylates, nonylphenol ethoxylate carboxylates and the like; sulfonates such as alkylsulfonates, alkylbenzenesulfonates, alkylarylsulfonates, sulfonated fatty acid esters and the like; sulfates such as sulfated alcohols, sulfated alcohol ethoxylates, sulfated alkylphenols, alkylsulfates, sulfosuccinates, alkylether sulfates and the like. Some particularly suitable anionic surfactants include, but are not limited to: sodium alkylarylsulfonate, alpha-olefinsulfonate and fatty alcohol sulfates.

Nonionic surfactants can be used for defoaming and as wetting agents. Exemplary nonionic surfactants useful in the detergent composition include those having a polyalkylene oxide polymer as a portion of the surfactant molecule. Examples of suitable nonionic surfactants include, but are not limited to: chlorine-, benzyl-, methyl-, ethyl-, propyl, butyl- and alkyl-capped polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates and the like; nonylphenol ethoxylate, polyoxyethylene glycol ethers and the like; carboxylic acid esters such as glycerol esters, polyoxyethylene esters, ethoxylated and glycol esters of fatty acids and the like; carboxylic amides such as diethanolamine condensates, monoalkanolamine condensates, polyoxyethylene fatty acid amides and the like; and polyalkylene oxide block copolymers including an ethylene oxide/propylene oxide block copolymer. Examples of particularly suitable nonionic surfactants include, but are not limited to: a $C_{12}$-$C_{14}$ fatty alcohol with 3 moles of ethylene oxide (EO) and 6 moles of propylene oxide (PO) and a PO-EO-PO block copolymer surfactant. Examples of suitable commercially available nonionic surfactants include, but are not limited to: PLURONIC 25R2, available from BASF Corporation, Florham Park, N.J.; ABIL B8852, available from Goldschmidt Chemical Corporation, Hopewell, Va.; and Dehypon LS-36 available from Cognis, headquartered in Monheim, Germany.

Cationic surfactants useful for inclusion in the detergent composition include, but are not limited to: amines such as primary, secondary and tertiary amines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

In one embodiment, the detergent composition is also substantially free of phosphorus-containing compounds. Substantially phosphorus-free refers to a composition to which phosphorus-containing compounds are not added. In an exemplary embodiment, the detergent composition includes less than approximately 2 wt % phosphates, phosphonates, and phosphites, or mixtures thereof. Particularly, the detergent composition includes less than approximately 1 wt % phosphates, phosphonates, and phosphites. More particularly, the detergent composition includes less than approximately 0.5 wt % phosphates, phosphonates, and phosphites. Most particularly, the detergent composition includes less than approximately 0.1 wt % phosphates, phosphonates, and phosphites.

In another embodiment, the detergent composition is also substantially free of alkali earth metals. Substantially alkali earth metal-free refers to a composition to which alkali earth metals are not added. In an exemplary embodiment, the detergent composition includes less than approximately 1 wt % alkali earth metals or mixtures thereof by weight. Particularly, the detergent composition includes less than approximately 0.5 wt % alkali earth metals. More particularly, the detergent composition includes less than approximately 0.1 wt % alkali earth metals. Most particularly, the detergent composition includes less than approximately 0.05 wt % alkali earth metals.

Additional Functional Materials

The detergent compositions can include additional components or agents, such as additional functional materials. As such, in some embodiments, the detergent composition including the alkalinity source and surfactant component may provide a large amount, or even all of the total weight of the detergent composition, for example, in embodiments having few or no additional functional materials disposed therein. The functional materials provide desired properties and functionalities to the detergent composition. For the purpose of this application, the term "functional materials" include a material that when dispersed or dissolved in a use and/or concentrate solution, such as an aqueous solution, provides a beneficial property in a particular use. The detergent compositions containing the alkalinity source and surfactant component may optionally contain other soil-digesting components, surfactants, disinfectants, sanitizers, acidulants, complexing agents, corrosion inhibitors, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Thickening Agents

Thickeners useful in the present invention include those compatible with alkaline systems. The viscosity of the detergent composition increases with the amount of thickening agent, and viscous compositions are useful for uses where the detergent composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt % to about 3 wt %, from about 0.1 wt % to about 2 wt %, or about 0.1 wt % to about 0.5 wt %.

Dyes and Fragrances

Various dyes, odorants including perfumes, and other aesthetic enhancing agents may also be included in the detergent composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylakor Acid Bright Red (Pylam), and the like. Fragrances or perfumes that may be included in the compositions include, for example, terpenoids such as citronellol, aldehydes such as amyl cinnamaldehyde, a jasmine such as ClS-jasmine or jasmal, vanillin, and the like.

Bleaching Agents

The detergent composition can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The detergent composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the detergent composition can be enhanced by the addition of a material which, when the detergent composition is placed in use, reacts with the active oxygen to form an activated component. For example, in some embodiments, a peracid or a peracid salt is formed. For example, in some embodiments, tetraacetylethylene diamine can be included within the detergent composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the detergent composition is in the form of a solid block, and an activator material for the active oxygen is coupled to the solid block. The activator can be coupled to the solid block by any of a variety of methods for coupling one solid detergent composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the detergent composition, such as by a plastic or shrink wrap or film.

Stabilizing Agents

The detergent composition may also include stabilizing agents. Examples of suitable stabilizing agents include, but are not limited to: borate or propylene glycol and mixtures thereof.

Dispersants

The detergent composition may also include dispersants. Examples of suitable dispersants that can be used in the solid detergent composition include, but are not limited to: maleic acid/olefin copolymers, polyacrylic acid, and mixtures thereof.

Hardening Agents/Solubility Modifiers

The detergent composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

Adjuvants

The present composition can also include any number of adjuvants. Specifically, the detergent composition can include stabilizing agents, wetting agents, foaming agents, corrosion inhibitors, biocides and hydrogen peroxide among any number of other constituents which can be added to the composition. Such adjuvants can be pre-formulated with the present composition or added to the system simultaneously, or even after, the addition of the present composition. The detergent composition can also contain any number of other constituents as necessitated by the application, which are known and which can facilitate the activity of the present compositions.

Rinse Aid Composition

A rinse aid composition is also included. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

The rinse aid composition includes a sugar ester to aid in removing protein soils/preventing redeposition of soils onto the surface being cleaned. Sugars provide an inexpensive alternative to components traditionally employed to remove protein soils and function as an anti-redeposition agent. In addition, sugars are biodegradable and are Generally Recognized as Safe (GRAS). The sugar can be a saccharide or a non-saccharide based sugar. Exemplary suitable saccharide based sugars include, but are not limited to: glucose, fructose, galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose and combinations thereof. An example of a particularly suitable saccharide based sugars includes, but is not limited to, sucrose. Exemplary suitable non-saccharide based sugars include, but are not limited to: arabitol, erythrithol, glycerol, isomalt, lactitol, maltitol, mannitol, sorbitol, xylitol, hydrogenated starch hydrosylate, sucralose, glycyrrhizin, monatin, tagatose and combinations thereof. An example of a particularly suitable non-saccharide based sugar includes, but is not limited to, sorbitol. Combinations of saccharide and non-saccharide based sugars may also be used.

In the present invention, the rinse aid composition comprises of between about 40 to about 90 weight percent, preferably about 80 weight percent, sucrose aliphatic ester and about 2 to about 30 weight percent, preferably about 20 weight percent, sorbitan aliphatic ester.

Delivery Mode of Detergent Composition/Rinse Aid Composition

The concentrate detergent composition/rinse aid composition of the present invention can be provided as a solid, liquid, or gel, or a combination thereof. In one embodiment, the detergent compositions/rinse aid compositions may be provided as a concentrate such that the detergent composition/rinse aid composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

When the detergent composition/rinse aid composition includes water in the concentrate, it should be appreciated that the water may be provided as deionized water or as softened water. The water provided as part of the concentrate can be relatively free of hardness. It is expected that the water can be deionized to remove a portion of the dissolved solids. Although deionized water is preferred for formulating the concentrate, the concentrate can be formulated with water that has not been deionized. That is, the concentrate can be formulated with water that includes dissolved solids, and can be formulated with water that can be characterized as hard water.

The water used to dilute the concentrate (water of dilution) can be available at the locale or site of dilution. The water of dilution may contain varying levels of hardness depending upon the locale. Service water available from various municipalities has varying levels of hardness. It is desirable to provide a concentrate that can handle the hardness levels found in the service water of various municipalities. The water of dilution that is used to dilute the concentrate can be characterized as hard water when it includes at least 10 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water to at least 10 ppm and up to 100 ppm.

In an alternate embodiment, the detergent compositions/rinse aid compositions may be provided as a ready-to-use (RTU) composition. If the detergent composition/rinse aid composition is provided as a RTU composition, a more significant amount of water is added to the detergent composition/rinse aid composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little water as possible in order to reduce transportation costs, it is also desirable to provide a concentrate that can be dispensed accurately. In the case of a liquid concentrate, it is expected that water will be present in an amount of up to about 90 wt %, particularly between about 20 wt % and about 85 wt %, more particularly between about 30 wt % and about 80 wt. % and most particularly between about 50 wt % and about 80 wt %.

In the case of a RTU composition, it should be noted that the above-disclosed detergent composition may, if desired, be further diluted with up to about 96 wt % water, based on the weight of the detergent composition.

Dish Machine(s) Used with the Method of Removing and Preventing Re-Deposition of Protein Soils The method of removing and preventing re-deposition of protein soils is best used in recirculated warewash machines. Recirculated warewash dish machines are typically used for high temperature machines, specifically machines which include water at a temperature range of about 150 degrees Fahrenheit to about 200 degrees Fahrenheit. High temperature dish machines offer the benefits of better cleaning results, faster drying times, no chlorine odors and shorter cycle times.

In recirculated warewash dish machines, there is a three part sequence of a cleaning cycle, a detergent step, a rinse step and end of cycle step. First in a detergent step, water from a wash tank is pumped through wash arms over the wares to be washed which usually lasts for about 45 seconds. Next, during the rinse step, heated water under pressure is forced through the rinse arms over the wares to be rinsed and this usually lasts for about 12-15 seconds. Lastly, during the end of the cycle, rinse water from the previous steps is collected in a wash tank and it displaces a like amount of volume down the drain. The advantages of recirculated warewash dish machines are that the cycle times are faster because there is no drain and fill during the middle of the cycle, there is no carry-over of detergent and/or soils to the wares at the end of the cycle, and separate mechanical systems for the detergent and rinse steps allows for optimization of both steps.

Recirculated warewash dish machines are door machines wherein the dish rack is kept stationary and only the wash/rinse arms move. Door dish machines can be used for both high and low temperatures and generally includes high pressure, low flow wash/rinse arms. The cycle time for a high temperature door machine is about 60 seconds (60 racks/hour (1500 dishes/hour)) For recirculating warewash dish machines, usually 0.8-1.2 gallons of water are used per rack. Exemplary dish machines which can be used with the current invention are Ecolab Inferno, Autochlor A5, or Hobart AM-14 all commercially available by Ecolab USA, Inc in Saint Paul, Minn. or by Hobart Corporation in Troy, Ohio.

Method of Removing and Preventing Re-Deposition of Protein Soils

In use, a detergent composition is applied to a surface to be washed during a detergent wash step of a first cleaning cycle. A cleaning cycle may include at least a detergent wash step and a rinsing step and may optionally also include a pre-soaking step. The detergent wash step involves dissolving the detergent composition in water to form a wash water composition, which may include components such as, for example, alkalinity sources, builders, surfactants, corrosion inhibitors and the like. Next, a rinse aid composition is applied to a surface to be rinsed during the first rinse step. During the rinse step, generally warm or hot water flows over the surfaces to be rinsed. The water temperature can be around 100 degrees Fahrenheit to about 200 degrees Fahrenheit.

In the second and subsequent cleaning cycles during the detergent wash step, the detergent composition and the rinse aid composition including the protein-removing/anti-redeposition agent from the recycled sump water contacts the surface and works to clean protein and other residue from the surface. In addition, the protein-removing/anti-redeposition agent aids in preventing soils from depositing onto the surface. Without being bound by theory, it is believed that the heat and alkalinity from the wash water composition during the detergent wash step breaks the sugar ester in the protein-removing/anti re-deposition agent into sucrose in the sump water from previous cleaning cycles which contacts the surface and works to clean protein and other residue from the surface.

After the detergent wash step, during a rinsing step, water flows over the surfaces to be rinsed to thoroughly rinse the detergent composition off of the surfaces. This water is used to form a sump water composition which includes a mixture of used detergent composition and used rinse aid composition. Part of this sump water composition is drained off and some of it is recycled back into use for a second cleaning cycle. During a second detergent step, the sump water composition includes the fresh wash water with rinse aid composition and the detergent composition which is applied to a surface to be washed during the detergent wash step of the second cleaning cycle. Afterwards, the entire sequence described above is repeated.

The entire sequence described above is repeated in subsequent cleaning cycles and with each separate cycle the concentration of sucrose in the sump water composition is gradually increased. Without being bound by theory, it is believed that the dissolved sucrose in the sump water composition comes into contact with the surfaces to be washed and aids in preventing soils from depositing onto the surface.

This entire sequence is repeated until the sump water composition becomes too concentrated with soils at which point the entire sump water composition is drained and the process is re-started from a first cleaning cycle.

Although the sugar-based protein-removing/anti-redeposition agent is discussed as being a part of the rinse aid composition, the sugar can optionally be added to the detergent wash step of the cleaning cycle as a separate component. Thus, the sugar may be introduced into the cleaning cycle independent of a detergent composition or a rinse aid composition. When provided as a separate component, the sugar may be provided at a relatively high level of sugar, up to about 100%, in liquid or solid form and may be introduced manually or automatically.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

Ryoto Sugar Ester: a $C_{28}H_{52}O_{12}$ sucrose mono palmitate available from Mitsubishi-Kasei Foods Corporation, headquartered in Tokyo, Japan.

Nikkol SK-10: a sorbitan monocaprylate available from Ecolab, Inc, headquartered in St. Paul, Minn., USA.

Glycomul L: a sorbitan monolaurate available from Lonza, Inc, headquartered in Fair Lawn, N.J., USA.

Apex Power: a detergent available from Ecolab, Inc, headquartered in St. Paul, Minn., USA Multi-Cycle Spot, Film and Soil Removal Test Method To test the ability of compositions to clean glass and plastic, twelve 10 oz. Libbey heat resistant glass tumblers and four Newport plastic tumblers were used. The glass tumblers were cleaned prior to use.

A food soil solution was prepared using a 50/50 combination of beef stew and hot point soil. The concentration of the solution was about 2000 ppm. The soil included two 24 oz cans of Dinty Moore Beef Stew (1360 grams), one 29 oz can of Hunt's tomato sauce (822 grams), 15.5 sticks of Blue Bonnet Margarine (1746 grams) and Nestle Carnation Instant Dry milk (436.4 grams).

The dish machine was then filled with an appropriate amount of water. After filling the dish machine with the water, the heaters were turned on. The final rinse temperature was adjusted to about 180° F. The glasses and plastic tumblers on one half of the rack were soiled by rolling the glasses in a 1:1 (by volume) mixture of Campbell's Cream of Chicken Soup: Kemp's Whole Milk three times. The glasses were then placed in an oven at about 160° F. at 50% relative humidity for about 8 minutes. While the glasses were drying, the dish machine was primed with about 120 grams of the food soil solution, which corresponds to about 2000 ppm of food soil in the sump.

The soiled glass and plastic tumblers were placed in the Raburn rack (see figure below for arrangement; P=plastic tumbler; G=glass tumbler) and the rack was placed inside the dish machine. The first two columns with the tumblers were tested for soil removal while the second two columns with the tumblers were tested for redeposition.

| | | | | | |
|---|---|---|---|---|---|
| | | G | G | | |
| | | G | G | | |
| | P | G | G | P | |
| | P | G | G | P | |
| | | G | G | | |
| | | G | G | | |

The dish machine was then started and run through an automatic cycle. When the cycle ended, the top of the glass and plastic tumblers were mopped with a dry towel. The glass and plastic tumblers being tested for soil removal were removed and the soup/milk soiling procedure was repeated. The redeposition glass and plastic tumblers were not removed. At the beginning of each cycle, an appropriate amount of detergent and food soil were added to the wash tank to make up for the rinse dilution. The soiling and washing steps were repeated for seven cycles.

The glass tumblers were then graded for protein accumulation using Coommassie Brilliant Blue R stain followed by destaining with an aqueous acetic acid/methanol solution. The Coommassie Brilliant Blue R stain was prepared by combining about 1.25 g of Coommassie Brilliant Blue R dye with about 45 mL of acetic acid and about 455 mL of 50% methanol in distilled water. The destaining solution consisted of 45% methanol and 10% acetic acid in distilled water. The amount of protein remaining on the glass and after destaining was rated visually on a scale of 1 to 5. A rating of 1 indicated no protein was present after destaining. A rating of 2 indicated that random areas (barely perceptible) were covered with protein after destaining. A rating of 3 indicated that about a quarter of the surface was covered with protein after destaining. A rating of 4 indicated that about half of the glass/plastic surface was covered with protein after destaining. A rating of 5 indicated that the entire surface was coated with protein after destaining.

The ratings of the glass tumblers tested for protein removal were averaged to determine an average protein removal rating from glass surfaces. Similarly, the ratings of the glass tumblers tested for redeposition were averaged to determine an average protein redeposition rating for glass surfaces.

Test Results

All tests were performed using the Multi-Cycle Spot, Film and Soil Removal Test description above. All the tests for this set of experiments were run on a Hobart AM 14 dish machine (Model Number 110976) manufactured by Hobart Corporation in Troy, Ohio. All tests were performed with Apex Power LP detergent, which is commercially available by Ecolab USA, Inc in Saint Paul, Minn. at a concentration of 1000 ppm. The formulas for the rinse aid compositions used are illustrated below in Table 1. The components are based on weight percent of the total weight percent of the composition. The rinse aid compositions used for testing are commercially available by Ecolab USA, Inc at Saint Paul, Minn. under the commercial names of Vanguard Solid Crystal, Rinse Dry and Ecoline JP-D. The variable test parameters are illustrated below in Table 2. The test results are illustrated below in Table 3.

TABLE 1

Rinse Aid Formulations

| | Vanguard Solid Crystal | Rinse Dry | Ecoline JP-D |
|---|---|---|---|
| Soft Water | 0.0005-0.002 wt. % | 80-95 wt. % | 60-70 wt. % |
| Sucrose Monopalmatate Ester | 60-80 wt. % | | |
| Sorbitan Monocaprylate | 10-20 wt. % | | |
| Sorbitan Laurate | 2-10 wt. % | | |
| Alcohol Alcoxylate | | 2-5 wt. % | |
| Polyoxyethylene Polyoxypropylene block polymer | | 2-5 wt. % | |
| Phosphonic Acid | | 0.1-1 wt. % | |
| Fatty Acid Ester | | | 10-30 wt. % |
| Glycerine | | | 5-10 wt. % |
| Ethyl Alcohol | | | 2-5 wt. % |

TABLE 2

Test parameters

| Parameter | Example 1 | Comparative Example A | Comparative Example B | Comparative Example C |
|---|---|---|---|---|
| Water hardness | 5.0 grn | 5.0 grn | 4.5 grn | 4.5 grn |

TABLE 2-continued

| Test parameters | | | | |
|---|---|---|---|---|
| Parameter | Example 1 | Comparative Example A | Comparative Example B | Comparative Example C |
| Rinse aid composition | 5% solution of Vanguard Solid Crystal | n/a | Rinse Dry | Ecoline JP-D |
| Rinse aid composition used per rinse | 4 mL (50 ppm actives) | n/a | 1 mL (20 ppm actives) | 1 mL (50 ppm actives) |

TABLE 3

| Test Results | | | | |
|---|---|---|---|---|
| | Example 1 | Comp. Example A | Comp. Example B | Comp. Example C |
| Soil Removal | | | | |
| Average Glass Rating | 1.5 | 3.0 | 2.0 | 2.5 |
| Redeposition | | | | |
| Average Glass Rating | 1.0 | 1.0 | 1.0 | 1.0 |

For all tests performed, the water hardness was held constant at around 4.5-5 grains. For Example 1, a 5% solution of a commercially available rinse aid composition (Vanguard Solid Crystal) was used at 50 ppm active. For Comparative Example A, no rinse aid composition was used. For Comparative Example B, a 5% solution of a commercially available rinse aid composition (Rinse Dry) was used at 20 ppm active. Lastly, for Comparative Example C, a 5% solution of a commercially available rinse aid composition (Ecoline JP-D) was used at 50 ppm active.

From the test results, it is clearly evident that all four of the tests results performed equally well in preventing redeposition on the glasses. However, the compositions which included a rinse aid composition were more effective in soil removal than the composition which did not include any rinse aid composition. Specifically, the rinse aid composition described in the current invention (Example 1) performed the best in terms of soil removal.

We claim:

1. A method of removing protein soils from a surface of a ware and preventing redeposition of protein soils onto the surface, the method comprising:

(a) introducing a recycled wash water composition from a sump of a recirculating warewash machine into a wash chamber of the recirculating warewash machine during a cleaning cycle, wherein:

(i) the ware is disposed within the wash chamber and remains stationary during the cleaning cycle; and (ii) the recycled wash water composition comprises wash water composition and rinse aid composition from one or more previous cleaning cycles, wherein the wash water composition comprises water and a detergent composition comprising an alkalinity source and the rinse aid composition comprises water and a protein-removing/anti-redeposition agent comprising a sugar ester;

(b) washing the surface of the ware with the recycled wash water composition during a detergent wash step of the cleaning cycle, wherein sugar ester present within the recycled wash water composition reacts under the conditions of the detergent wash step to form sucrose and the sucrose in the recycled wash water composition removes protein soils from the surface of the ware and prevents protein soil in the recycled wash water composition from redepositing on the surface of the ware;

(c) collecting the recycled wash water composition from the detergent wash step in the sump;

(d) introducing an amount of the rinse aid composition into the wash chamber during a rinse step of the cleaning cycle, wherein the rinse step is subsequent to completion of the detergent wash step;

(e) collecting the rinse aid composition from the rinse step in the sump, wherein the collected rinse aid composition and the recycled wash water composition form a sump water composition after the cleaning cycle;

(f) recycling the sump water composition into a subsequent cleaning cycle, wherein the sump water composition comprises the recycled wash water composition for the detergent step of the subsequent cleaning cycle; and (g) repeating steps (a) through (e) followed by step (f) in one or more additional subsequent cleaning cycles;

wherein a concentration of sucrose in the recycled wash water composition of each subsequent cleaning cycle is increased by the recycling of the sump water composition.

2. The method of claim 1, wherein the wash water composition has a temperature range of about 100 degrees Fahrenheit to about 200 degrees Fahrenheit.

3. The method of claim 1, wherein the surface is glass, ceramic, metal, or plastic.

4. The method of claim 1, wherein the sugar ester comprises sucrose aliphatic ester, sorbitan aliphatic ester, or a mixture thereof.

5. The method of claim 4, wherein the rinse aid composition comprises between about 40 to about 90 weight percent sucrose aliphatic ester and about 2 to about 30 weight percent sorbitan aliphatic ester.

6. The method of claim 4, wherein the sucrose aliphatic ester comprises sucrose monopalmitate.

7. The method of claim 4, wherein the sorbitan aliphatic ester comprises at least one of: sorbitan monocaprylate or sorbitan monolaurate.

8. A method of removing protein soils from a surface of a ware and preventing redeposition of protein soils onto the surface, the method comprising:

(a) introducing a wash water composition into a wash chamber of a recirculating warewash machine during a first cleaning cycle, wherein the ware is disposed within the wash chamber and remains stationary in the recirculating wash machine during the cleaning cycle and the wash water composition comprises water and a detergent composition, the detergent composition comprising an alkalinity source;

(b) washing the surface of the ware with the wash water composition during a detergent wash step of the first cleaning cycle;

(c) introducing a first rinse aid composition into the wash chamber during a rinse step of the first cleaning cycle, wherein the rinse step is subsequent to completion of the detergent wash step and the rinse aid composition comprises water and a protein-removing/anti-redeposition agent, the protein-removing/anti-redeposition agent comprising a sugar ester;

(d) forming a sump water composition after the first cleaning cycle comprising collecting the wash water composition from (b) and the first rinse aid composition from (c) in a sump of the recirculating warewash machine;

(e) recycling the sump water composition into a subsequent cleaning cycle, wherein the subsequent cleaning cycle comprises:

(i) loading a protein soiled ware into the wash chamber;

(ii) introducing a recycled wash water composition into the wash chamber during the subsequent cleaning cycle, wherein the recycled wash water composition comprises water, the recycled sump water composition, and an additional amount of the detergent composition;

(iii) washing a surface of the soiled ware with the recycled wash water composition during the detergent wash step of the subsequent cleaning cycle, wherein sugar ester present within the recycled wash water composition reacts under the conditions of the detergent wash step of the subsequent cleaning cycle to form sucrose and wherein the sucrose removes protein soil from the surface of the ware and prevents protein soil in the sump water composition from redepositing on the surface of the ware during the detergent wash step of the subsequent cleaning cycle;

(iv) introducing a second rinse aid composition comprising water and the protein-removing/anti-redeposition agent into the wash chamber during the rinse step of the subsequent cleaning cycle; and (v) collecting the recycled wash water composition from (iii) and the second rinse aid composition from (iv) in the sump of the recirculating warewash machine to form a second sump water composition;

(f) recycling the second sump water composition into an additional subsequent cleaning cycle; and (g) repeating the one or more additional subsequent cleaning cycles according to step (e);

wherein a concentration of sucrose in the recycled wash water composition of each subsequent cleaning cycle is increased by the recycling of the sump water composition.

9. The method of claim 8, wherein the wash water composition has a temperature range of about 100 degrees Fahrenheit to about 200 degrees Fahrenheit.

10. The method of claim 8, wherein the surface is glass, ceramic, metal, or plastic.

11. The method of claim 8, wherein the sugar ester comprises sucrose aliphatic ester, sorbitan aliphatic ester, or a mixture thereof.

12. The method of claim 11, wherein the rinse aid composition comprises between about 40 to about 90 weight percent sucrose aliphatic ester and about 2 to about 30 weight percent sorbitan aliphatic ester.

13. The method of claim 11, wherein the sucrose aliphatic ester comprises sucrose monopalmitate.

14. The method of claim 11, wherein the sorbitan aliphatic ester comprises at least one of: sorbitan monocaprylate or sorbitan monolaurate.

* * * * *